United States Patent [19]

Isozumi et al.

[11] Patent Number: 4,868,407

[45] Date of Patent: Sep. 19, 1989

[54] ENGINE STARTER MOTOR

[75] Inventors: Shuzo Isozumi; Toshinori Tanaka, both of Hyogo, Japan

[73] Assignee: Mitsubishi Denki Kabushiki Kaisha, Tokyo, Japan

[21] Appl. No.: 203,365

[22] Filed: May 27, 1988

[30] Foreign Application Priority Data

May 27, 1987 [JP] Japan ..... 62-134292

[51] Int. Cl.[4] ..... F02N 11/00

[52] U.S. Cl. ..... 290/48; 74/7 A

[58] Field of Search ..... 290/48, 38 R; 123/179 R, 179 M; 74/6, 7 R, 7 A

[56] References Cited

U.S. PATENT DOCUMENTS

| | | | |
|---|---|---|---|
| 4,520,285 | 5/1985 | Isozumi et al. | 74/7 A X |
| 4,561,316 | 12/1985 | Bolz et al. | 74/7 E |
| 4,604,907 | 8/1986 | Morishita et al. | 74/7 E |
| 4,661,715 | 4/1987 | Volino | 290/48 |
| 4,671,125 | 6/1987 | Yabunaka | 290/48 X |

*Primary Examiner*—William M. Shoop, Jr.
*Assistant Examiner*—W. E. Duncanson, Jr.
*Attorney, Agent, or Firm*—Sughrue, Mion, Zinn, Macpeak and Seas

[57] ABSTRACT

A starter motor of the so-called overhang type in which a portion of the pinion 109 which has no teeth slides through a bearing 119 provided in the front bracket, comprises an output shaft 105 composed of a first portion 105*a* on which a helical spline 107 is formed, a second portion 105*b* having a smaller diameter than that of the first portion on which an inner member 108 of an over-running clutch 104 slides together with a bearing 110 provided on an inner surface thereof, and a third portion having a smaller diameter than that of the second portion on which a stopper member 113 for restricting an axial slide movement of a pinion is provided and the pinion having an inner diameter of a portion thereof on which the pinion teeth are formed smaller than an inner diameter of the inner member.

9 Claims, 2 Drawing Sheets

ENGINE STARTER MOTOR

BACKGROUND OF THE INVENTION

The present invention relates to an engine starter motor and, particularly, to an improvement of a pinion thereof which meshes with a ring gear of an engine.

FIG. 4 shows in cross section a portion of a conventional engine starter motor including an over-running clutch portion thereof. In FIG. 4, reference numeral 1 depicts an electromagnetic switch, 2 a plunger magnetically attracted in an arrow direction by the electromagnetic switch 1, and 3 is a lever rotatable about a point 3*a* upon an energization of the electromagnetic switch 1 to move the over-running clutch 4 forwardly. 5 depicts an output shaft of the starter motor, 6 is an outer of member the over-running clutch 4 meshing with a helical spline portion 7 of the output shaft 5, and 8 is an inner member of the clutch which has a pinion 9 formed integrally therewith. 10 depicts a bearing provided on an inner surface of the pinion 9 which slides along the output shaft 5, 11 is another bearing provided on a front end of a front bracket 12 for supporting a front end of the output shaft 5, 13 is a stopper provided on the output shaft 5 through a ring 14 for restricting a movement of the pinion 9 along the output shaft 5, 15 is a washer inserted between the front bracket 12 and the output shaft 5, 16 in a yoke of the d.c. motor, and 17 is a field coil for driving an armature 18 of the motor.

In operation, upon an application of a voltage to the electromagnetic switch 1, the plunger 2 is attracted to rotate the lever 3 in a counterclockwise direction about the point 3*a* to thereby move the over-running clutch 4 forwardly so that the pinion 9 supported thereby meshes with the ring gear of the engine. At the same time, a power supply from a vehicle mounted battery to the d.c. motor through a contact associated with the electromagnetic switch 1 is started, upon which the armature 18 of the d.c. motor is energized and a rotational force thereof is transmitted from the output shaft 5 through the over-running clutch 4 and the pinion 9 to the ring gear of the engine to rotate the latter. The forward movement of the pinion 9 is restricted by the stopper 13.

In the conventional starter motor constructed as above mentioned, the output shaft 5 is subjected to a bending moment due to a reactive force produced in the pinion 9. Particularly, the bending moment may be concentrated to a groove of the ring 14 of the stopper 13. Therefore, the diameter of the output shaft 5 as a whole must be selected large enough to withstand such moment, and a deddendum diameter of the pinion 9 must be large enough accordingly. Thus, the size and number of pinion teeth are restricted, resulting in the design freedom thereof, being degraded. Further, since the pinion 9 and the output shaft 5 are exposed from the front bracket 12, they may be subjected to external dust etc. causing the bearing supporting the pinion 9 to be worn away thereby and making the sliding movement of the pinion 9 difficult.

SUMMARY OF THE INVENTION

An object of the present invention is to provide an engine starter motor in which there is no bending moment produced and a smooth pinion movement is assured.

The starter motor according to the present invention is of the so-called overhang type in which a portion of the pinion which has no teeth slides through a bearing provided in the front bracket and comprises an output shaft composed of a first portion on which a helical spline is formed, a second portion having a smaller diameter than that of the first portion on which an inner member of an over-running clutch slides together with a bearing provided on an inner surface thereof, and a third portion having a smaller diameter than that of the second portion on which a stopper member for restricting an axial slide movement of a pinion is provided, the pinion having an inner diameter of a portion thereof on which the pinion teeth are formed smaller than an inner diameter of the inner member.

In the present invention, since the portion of the pinion which has no teeth is slidably supported by the bearing provided in the front bracket, and the portions of the output shaft on the front side of the bearing provided on the inner surface of the inner are not bearing-supported, there is no bending moment produced by reactive force of the pinion and exterted on the output shaft. Thus, it is possible to improve the design freedom of the pinion.

DETAILED DESCRIPTION OF THE PREFERRED EMBODIMENT

Figure 1:
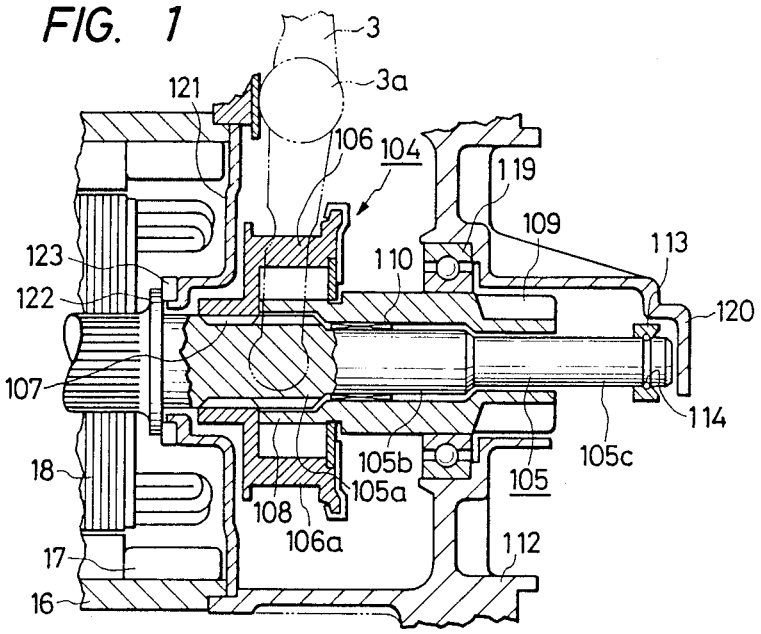
FIG. 1 is a cross section of a portion of a starter motor according to an embodiment of the present invention, showing an over-running clutch and associated portion thereof.

In FIG. 1 which shows an embodiment of the present invention, an over-running clutch 104 has an outer member 106 meshing with a helical spline portion 107 of an output shaft 105. A lever 3 engages with a groove 106*a* of the outer member 106. An inner member 108 of the over-running clutch 104 is formed with a pinion 109 integrally. A bearing 119 is provided in a front bracket 112 and slidably supports an outer periphery of the pinion 109 on which no teeth are formed. Another bearing 110 is fixedly provided on an inner periphery of the non-toothed portion of the pinion 109 and allows an axial relative movement of the pinion 109 to the output shaft 105. A stopper 113 is provided on a front end of the output shaft 105 through a ring 114 to restrict an axial movement of the pinion 109. The output shaft 105 includes three sections, a first section 105*a* having the helical spline 107 thereon, a second section 105*b* whose diameter is smaller than that of the first section 105*a* and on which the bearing 110 provided on the inner periphery of the inner member 108 is slidable and a third section 105*c* having a diameter smaller than that of the second section 105*b* and on which the stopper 113 is provided.

An inner diameter of the toothed portion of the pinion 109 is smaller than the diameter of the second shaft section 105*b* so that a small clearance is provided between an inner periphery of the toothed portion of the pinion 109 and the third shaft section 105*c*.

A housing 120 covers the output shaft 105 including the stopper 113 and the toothed portion of the pinion 109. A center bracket 121 is arranged between the front bracket 112 and a yoke 16 to receive thrust force of the output shaft 105 on a step portion 122 and a washer 123 thereof. Other components of this embodiment are the same as those used in the conventional device, respectively.

Figure 2:
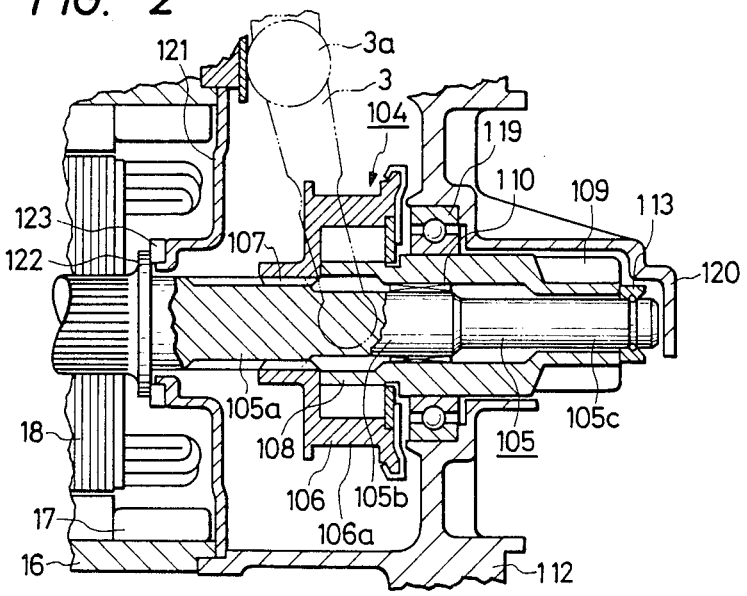
FIG. 2 is a similar cross section to that shown in Fig. 1, showing an operation thereof.

In operation, upon an application of a voltage to an electromagnetic switch (not shown), a plunger is magnetically attracted to rotate the lever 3 about a point 3*a* in a counterclockwise direction, as shown in FIG. 2, so that the over-running clutch 104 moves forwardly. The non-toothed portion of the pinion 109 slides through the bearing 119 provided in the front bracket 112, and the inner member 108 together with the bearing 110 moves forwardly until the front end of the pinion 109 abuts the stopper 113, at which point the pinion teeth mesh with a ring gear of the engine. At the same time, power is supplied from a battery through a closed contact of the electromagnetic switch to the motor to energize the armature 18 thereof. A rotational force of the motor is transmitted from the output shaft 105 through the over-running clutch 104 and the pinion 109 to the engine ring gear.

In this invention, the clearance between the toothed portion of the pinion 109 and the third shaft section 105*c* is selected to provide a satisfactory labxrinth effect on the first and the second shaft sections which may prolong the life of the bearing 110.

Since the pinion 109 and the stopper 113 are covered by the housing 120, there is no invasion of dust etc. into the bearing 110, eliminating the problems to be caused thereby.

Figure 3:
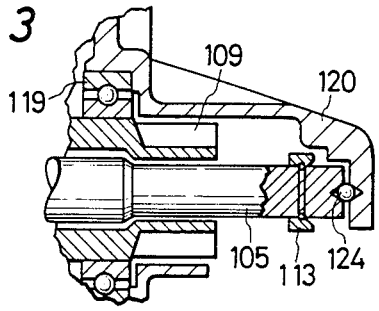
FIG. 3 is a cross section of another portion of the starter motor shown in FIG. 1, which receives thrust force of an output shaft thereof.

FIG. 3 shows another embodiment of the present invention which differs from that shown in FIG. 1, in which the thrust force of the output shaft 105 is received by the step portion 122 of the center bracket 121 provided between the front bracket 112 and the yoke 16 through the washer 123, in that the thrust force is received by a steel ball 124 disposed between the front end of the output shaft 105 and the housing 120.

Figure 4:
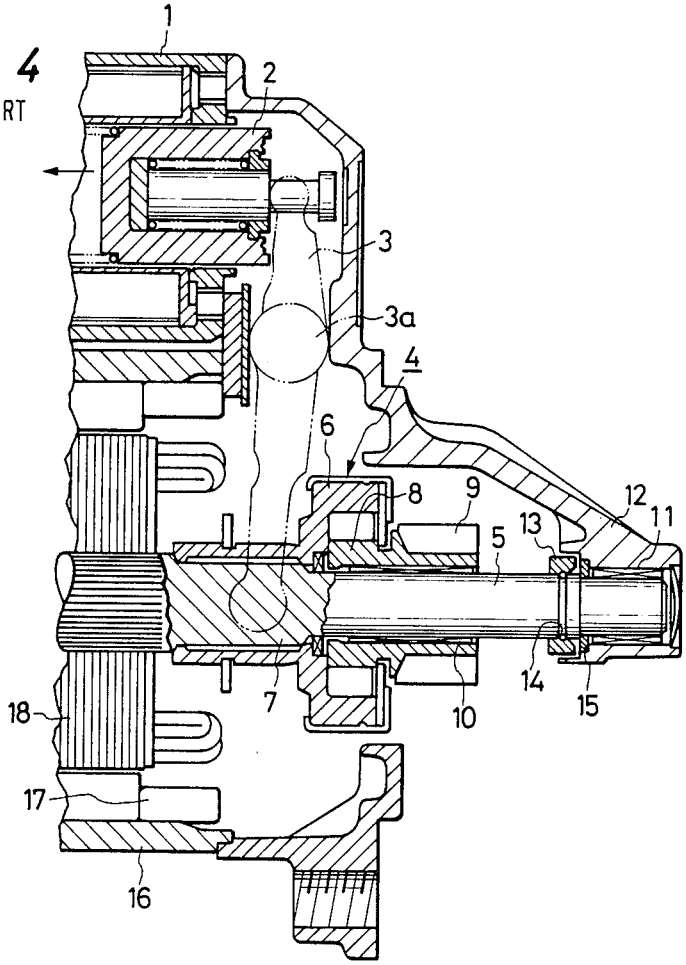
FIG. 4 PRIOR ART
FIG. 4 is a cross section of a similar portion of a conventional starter motor to that shown in FIG. 1.

Alternatively, such thrust may be received by a rear bracket (not shown) or by the washer on the end of the front bracket as in the conventional device shown in FIG. 4.

The coupling of the over-running clutch 104 to the lever 3 is not limited to that through the groove 106*a* of the outer member 106. It may be the same as that shown in FIG. 4. Further the present invention is also applicable to other starter motors than that of the shown type in which the armature core is fixedly mounted on the output shaft 105. An example of such starter motor may be that an armature shaft is coupled through a separately provided reduction mechanism to an output shaft.

What is claimed is:

1. In an engine starter motor in which a pinion (109) having a toothed portion to be meshed with an engine ring gear is formed integrally with an inner member (108) of an over-running clutch (104) and has a non-toothed portion slidable through a bearing (119) provided in a front bracket, an improvement comprising an output shaft (105) having a helical spline (107) to be meshed with an outer member (106) of said over-running clutch axially slidably, said output shaft including a first section (105*a*) on which said helical spline is formed, a second section (105*b*) having a diameter smaller than that of said first section and slidable axially through a bearing (110) fixedly provided on an inner surface of a portion of said pinion, and a third section (105*c*) having a diameter smaller than said diameter of said second section and having a stopper (113) on a front end thereof, said toothed portion of said pinion having an inner diameter smaller than said diameter of said second section of said output shaft.

2. The improvement as claimed in claim 1, wherein said inner diameter of said toothed portion of said pinion is selected to provide a small gap with respect to said third section of said output shaft.

3. The improvement as claimed in claim 1 or 2, wherein said inner diameter of said toothed portion of said pinion is smaller than an inner diameter of said bearing.

4. The improvement as claimed in claim 1 or 2, wherein said toothed portion of said pinion and said stopper on said third section of said output shaft are covered by a housing substantially.

5. The improvement as claimed in claim 3, wherein said toothed portion of said pinion and said stopper on said third section of said output shaft are covered by a housing substantially.

6. The improvement as claimed in claims 1 or 2, wherein said over-running clutch is driven forwardly by a lever (3) engaged with said outer member thereof, said lever being driven by a plunger of an electromagnetic switch associated with said motor.

7. The improvement as claimed in claim 3, wherein said over-running clutch is driven forwardly by a lever engaged with an outer member thereof, said lever being driven by a plunger of an electromagnetic switch associated with said motor.

8. The improvement as claimed in claim 4, wherein said over-running clutch is driven forwardly by a lever engaged with an outer member thereof, said lever being driven by a plunger of an electromagnetic switch associated with said motor.

9. The improvement as claimed in claims 1 or 2, wherein a steel ball (124) is disposed between said front end of said output shaft and a portion of said front bracket facing thereto.

* * * * *